US005148006A

United States Patent [19]

Driscoll

[11] Patent Number: 5,148,006

[45] Date of Patent: Sep. 15, 1992

[54] MECHANICAL DEVICE FOR DETERMINING THE MODULUS AND LOSS FACTOR OF A DAMPING MATERIAL BASED UPON TEMPERATURE AND FREQUENCY

[75] Inventor: William A. Driscoll, Maplewood, Minn.

[73] Assignee: Minnesota Mining and Manufacturing Company, St. Paul, Minn.

[21] Appl. No.: 428,873

[22] Filed: Oct. 30, 1989

[51] Int. Cl.[5] ..... G06G 1/02

[52] U.S. Cl. ..... 235/70 R; 235/70 A; 235/89 R

[58] Field of Search ..... 235/70 R, 70 A, 89 R; 116/321, 323

[56] References Cited

U.S. PATENT DOCUMENTS

| | | | |
|---|---|---|---|
| 2,179,531 | 11/1939 | Trapnell | 235/89 R |
| 3,045,908 | 7/1962 | Donovan | 235/70 R X |
| 3,341,117 | 9/1967 | Painter | 235/89 R |
| 4,346,288 | 8/1982 | Foster | 235/70 A |

*Primary Examiner*—Benjamin R. Fuller

*Assistant Examiner*—David Yockey

*Attorney, Agent, or Firm*—Merchant, Gould, Smith, Edell, Welter & Schmidt

[57] ABSTRACT

A device for providing the modulus and loss factor values of a damping material based upon temperature and frequency which includes (i) an insert having (a) temperature isotherms on one side, and (b) graphs of the modulus and loss factor values for the damping material as a variable of temperature and frequency on the other side, and (ii) a sleeve for the insert which has (aa) a temperature isotherm display window for displaying the temperature isotherms on the insert, (bb) a frequency scale proximate the temperature isotherm display window, and (cc) a means for highlighting a modulus value and a loss factor value from the modulus and loss factor graphs provided on the insert. The device is employed to obtain the modulus and loss factor values of a damping material at a particular frequency and temperature by (i) a coupling the temperature and frequency values of concern by sliding the insert within the sleeve until the isotherm representing the temperature of concern physically contacts the frequency value of concern, and (ii) reading the modulus value and loss factor value highlighted by the highlighting means.

20 Claims, 4 Drawing Sheets

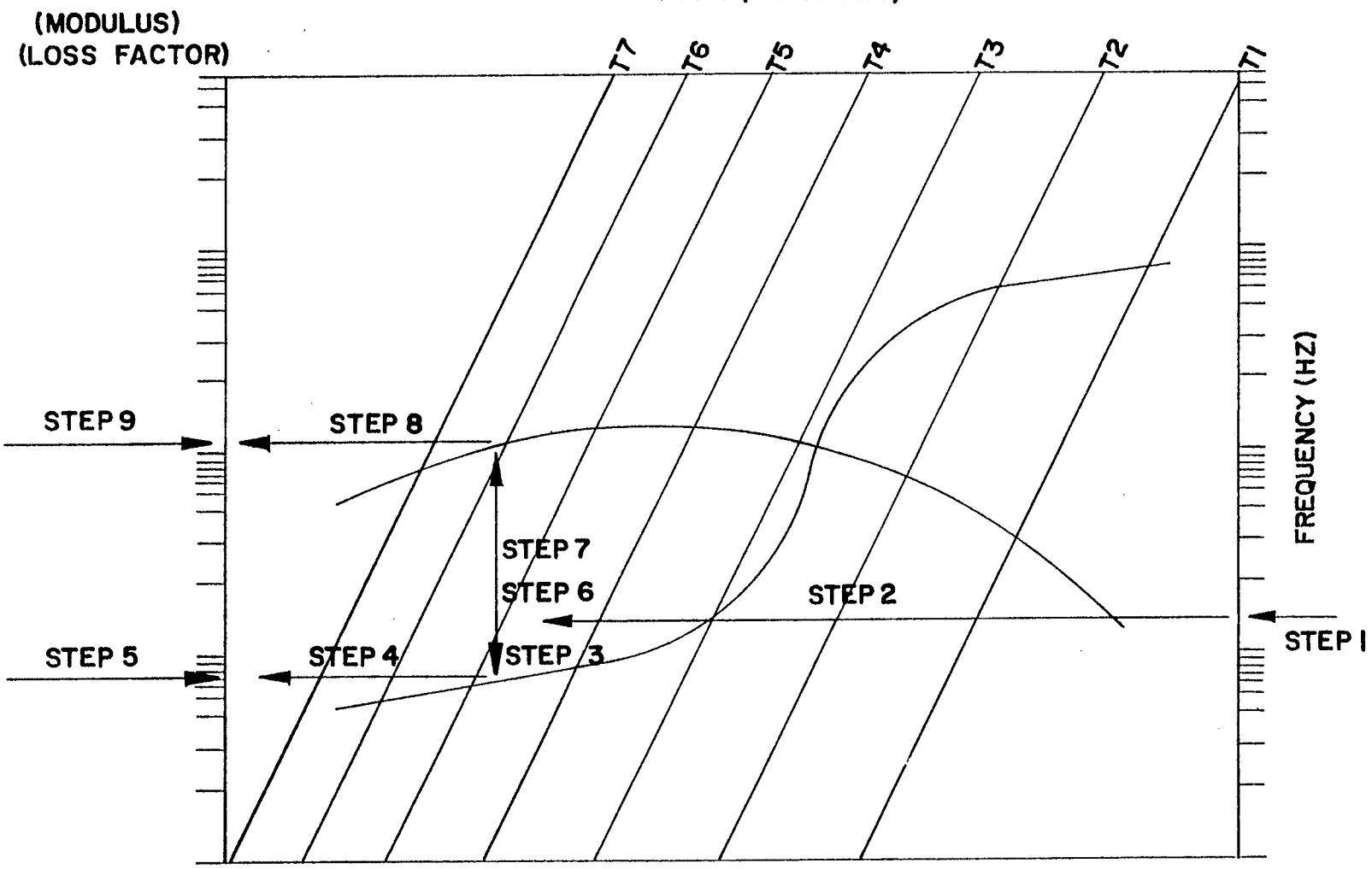
FIG. I (Prior Art)

MECHANICAL DEVICE FOR DETERMINING THE MODULUS AND LOSS FACTOR OF A DAMPING MATERIAL BASED UPON TEMPERATURE AND FREQUENCY

FIELD OF THE INVENTION

In a first sense, my invention relates to mechanical data storage and retrieval devices. In a second sense, my invention relates to methods for determining the modulus and loss factor of a damping material based upon temperature and frequency.

BACKGROUND OF THE INVENTION

Vibration is a physical phenomena characterized by oscillatory deformation of an elastic body about a position of equilibrium. The basic physical concepts involved in vibratory motion are fairly simple. Deformation of an elastic body in a first direction by the application of an external force provides the elastic body with an initial amount of mechanical energy in the form of potential energy ($p_1$). Removal of the external force results in movement of the deformed elastic body from the high-energy deformed position towards the low-energy equilibrium position. Movement of the elastic body from the deformed position to the equilibrium position intrinsically results in the irreversible dissipation of a portion of the mechanical energy (d1) and conversion of the remaining mechanical energy ($p_1-d_1$) from potential energy to kinetic energy ($k_1$). The thus converted kinetic energy causes the elastic body to move past the equilibrium position and result in deformation of the elastic body in a second direction. Deformation of the elastic body in the second direction intrinsically results in the irreversible dissipation of a second portion of the mechanical energy ($d_2$) and reconversion of the remaining mechanical energy ($p_1-(d_1+d_2)$) from kinetic energy back into potential energy. Movement of the elastic body reverses when the kinetic energy is completely converted to potential energy ($p_2$). The thus deformed elastic body possess an amount of potential energy ($p_2$) equal to the initial amount of potential energy ($p_1$) minus the amount of energy irreversibly dissipated ($d_1+d_2$). Oscillation of the elastic body about the equilibrium position continues until the cumulative amounts of energy irreversibly dissipated ($\Sigma d$) equals the amount of mechanical energy originally provided to the elastic body ($p_1$).

Vibration of a deformed elastic body can be perpetuated by periodically adding sufficient mechanical energy to the vibrating body to compensate for the energy lost through intrinsic dissipation.

The irreversible dissipation of mechanical energy from a vibrating elastic body is an intrinsic phenomena commonly referred to as damping. Damping is believed to result from a variety of energy loss mechanisms such as (i) the conversion of mechanical energy to heat through internal friction within the elastic body [hysteresis], (ii) the conversion of mechanical energy to heat through friction caused by the rubbing of one component of the elastic body against another, (iii) the transfer of mechanical energy from the vibrating elastic body to adjacent structural components, (iv) the transfer of mechanical energy from the vibrating elastic body to the environment through acoustic radiation, (v) the conversion of mechanical energy to heat through a viscous response either inherent in the system or subsequently added to the system.

The energy dissipation mechanisms themselves are very complex and dependant upon a great number of factors including specifically, but not exclusively: the composition of the elastic body, the crystallinity of the elastic body, the geometry of the elastic body, the temperature of the elastic body, the initial strain placed upon the elastic body, the amount of any preload placed upon the elastic body, the interrelationship between the elastic body and other bodies, the amplitude and frequency of the vibration, and the amount of viscous response.

Due to the variety of dissipative mechanisms and the internal complexity of those mechanism, it is extremely difficult to accurately predict the damping effect of a given material. However, despite such complexities, the material damping behavior for harmonic motion caused by normal stress/strain can generally be represented by the complex equation set forth below as Equation (1):

$$\sigma = E(1+i\,\Phi)\cap \tag{1}$$

wherein: $\sigma$ is normal stress (force/area)

E is normal modulus (dimensionless)

$\cap$ is normal loss factor (dimensionless)

$\Phi = iwe^{iwt}$ where: w is circular frequency t is time.

It is noted that similar considerations apply to the material damping behavior for harmonic motion caused by shear stress/strain and can be represented by the complex equation set forth below as Equation (2).

$$\delta = G(1+i\cap')\Gamma \tag{2}$$

wherein: $\delta$ is shear stress

G is shear modulus (dimensionless)

$\cap'$ is shear loss factor and is approximately equal to $\cap$ $\Gamma$ is shear strain.

Based upon these theoretical equations, the damping behavior of a material is dependent upon the modulus and loss factor of the material. Hence, knowledge of the modulus and/or loss factor of a material permits an assessment of the damping behavior of a material.

The modulus and loss factor variables of a damping material are highly dependent upon the temperature of the damping material and the vibration frequency. Hence, when representing experimental data of the modulus and/or loss factor of a material the representation must take into consideration the temperature and frequency at which such data was obtained.

Experimental data of the modulus and/or loss factor of a material is typically represented in the form of a reduced-temperature nomograph such as that depicted in FIG. 1. Reduced-temperature nomographs for a variety of damping materials are readily available from a number of sources including Soovere, J. and Drake, M. L., *Aerospace Structures Technology Damping Design Guide*, AFWAL-TR-843089, Volumes 1-3, December 1985 and Ferry, J. D., Viscoelastic Properties of Polymers, John Wiley & Sons, New York 1961. Depiction of the modulus and/or loss factor values of a material in the form of a reduced-temperature nomograph greatly simplifies determination of the modulus and loss factor values of a material by providing for display of the modulus and loss factor values verses both temperature and frequency on a single graph.

Use of a reduced-temperature nomograph to determine the modulus and loss factor of a material includes the steps of: (Step 1) locating the vibration frequency of concern on the right hand vertical axis of the nomograph, (Step 2) moving horizontally along that frequency line to the temperature isotherm representing the temperature of concern, (Step 3) moving vertically from that temperature/frequency coordinate to the modulus curve, (Step 4) moving horizontally from the modulus curve coordinate to the left vertical axis, (Step 5) reading the value of the modulus from the modulus scale provided on the left vertical axis, (Step 6) relocating the temperature/frequency coordinate found in step 2, (Step 7) moving vertically from the temperature/frequency coordinate to the loss factor curve, (Step 8) moving horizontally from the loss factor curve coordinate to the left vertical axis, and (Step 9) reading the value of the loss factor from the loss factor scale provided on the left vertical axis.

Advent of the reduced temperature nomograph constitutes a tremendous advancement over the previously employed method of determining modulus and loss factor based upon separate temperature and frequency graphs. However, even with the increased simplicity offered by reduced-temperature nomographs, many individuals, particularly those with a limited scientific background, still find it difficult to determine the modulus and loss factor of a material.

Accordingly, a substantial need exists for a simpler method of determining the modulus and loss factor of a damping material based upon temperature and frequency variables.

BRIEF DESCRIPTION OF THE DRAWINGS

FIG. 1 is a prior art reduced-temperature nomograph.

SUMMARY OF THE INVENTION

Figure 2C:
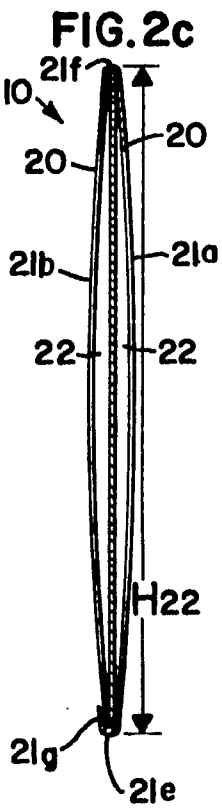
FIG. 2*c* is a side view of the invention depicted in FIG. 2*a* and 2*b* taken along line 2—2.

The invention is an inexpensive device which greatly simplifies retrieval of the modulus and loss factor values of a damping material as variables of temperature and frequency. The device has two interconnected portions which are movable with respect to one another in a restrained manner. A first of the portions includes (i) a temperature scale, (ii) a depiction of the modulus values for the damping material as a variable of temperature and frequency, and (iii) a depiction of the loss factor values for the damping material as a variable of temperature and frequency. The second portion includes (i) a frequency scale, and (ii) at least one means for highlighting a modulus value and a loss factor value from the modulus and loss factor values depicted on the first portion.

DETAILED DISCUSSION OF THE INVENTION INCLUDING A BEST MODE

Uncontrolled vibration can result in a number of troublesome side effects ranging from the generation of annoying sound to inoperability and/or destruction of the vibrating element(s). Because of these troublesome side effects, it is often desireable to control or damp the vibration of an element(s).

The definition of various terms employed in describing my invention are provided below in an effort to ensure a complete and thorough understanding of the invention.

DEFINITIONS

As utilized herein, the term "damping material" refers to any material capable of providing vibrational damping.

As utilized herein, the term "couple" means to connect in a predefined physical format for the purpose of joint consideration.

As utilized herein, the term "highlighting means" refers to any means for emphasizing a particular datapoint from a group of datapoints and includes such means as a display window, a hairline, a pointer, and the like.

As utilized herein, the term "modulus", unless otherwise specified, is used generically to refer to loss modulus, storage modulus and/or complex modulus of elasticity.

As utilized herein, the phrase "restrainably movable" means moveable in a limited and defined manner.

As utilized herein, the terms "window" and "display window" refer to a defined optical opening which provides viewing of a defined subset of data from a larger database.

Due to the complicated nature by which vibration is dissipated, the control of vibration through damping is a complicated and esoteric area of technology. Vibration damping can be achieved through a variety of design options but is most often achieved by attaching a damping material to the vibrating element(s). The damping material controls vibration through its ability to irreversibly dissipate relatively large amounts of energy when deformed. For example, the vibration of a disk drive read/write head can be controlled by adhesively bonding a damping material to the load beam of the read/write head such that the damping material will deform when the read/write head vibrates and thereby dissipate energy from the read/write head through a viscous response.

Selection of the most appropriate damping material for use in controlling the vibration of an element(s) can be an extremely complicated process. The damping ability of a material is dependant upon several interrelated factors such as the composition of the damping material, the geometry of the damping material, the geometry of the vibrating element(s), the shape of the vibrating element(s) structural load, the frequency and amplitude of the vibration, the temperature of the vibrating element(s), the temperature of the damping material, and the composite stiffness of the damping material in conjunction with the vibrating element.

Two characteristics commonly employed in the selection of a damping material are the modulus (E), typically the complex modulus (E*), and loss factor (∩) of the material. The complex modulus E* represents the vector sum of in-phase, storage modulus E' and out-of-phase, loss modulus E''. The loss factor ∩ represents the ratio of loss modulus E'' to storage modulus E'. Storage modulus E' represents the amount of energy stored by a system under stress which is completely recoverable while loss modulus E'' represents the amount of energy irretrievably lost by a system under stress through such mechanisms as the dissipation of energy in the form of heat.

As a general rule, a damping material having a high combination of modulus and loss factor values, particularly modulus, will be more effective at controlling vibration than a damping material having a low combination of modulus and loss factor values.

The modulus (E) and loss factor (∩) values of a material are highly dependent upon temperature (T) and vibratory frequency (f). Because of this dependency, the modulus and loss factor values of damping materials are generally expressed in the form of a reduced-temperature nomograph [FIG. 1] which provides the modulus (E) and loss factor (∩) values of a material in relationship to both temperature and frequency.

My invention greatly simplifies determination of the modulus (E) and loss factor (∩) values for a damping material as variables of temperature and frequency by providing the experimentally derived values of modulus (E) and loss factor (∩) of a given damping material in a user friendly format.

Briefly, my invention provides the modulus, loss factor, temperature and frequency information in such a manner that coupling of a temperature value from a temperature scale provided on a first portion with a frequency value from a frequency scale provided on a second portion by movement of the first and second portions relative to one another causes a highlighting means to highlight the modulus value and the loss factor value of the damping material at the coupled temperature and frequency values.

Figure 2A:
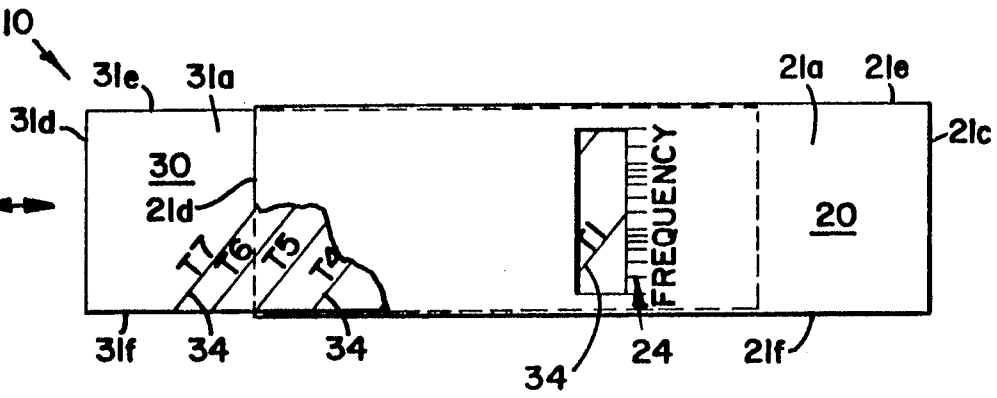
FIG. 2*a* is a is a front view of one embodiment of the invention with a section of the sleeve broken-away to facilitate viewing of the insert.
Figure 2B:
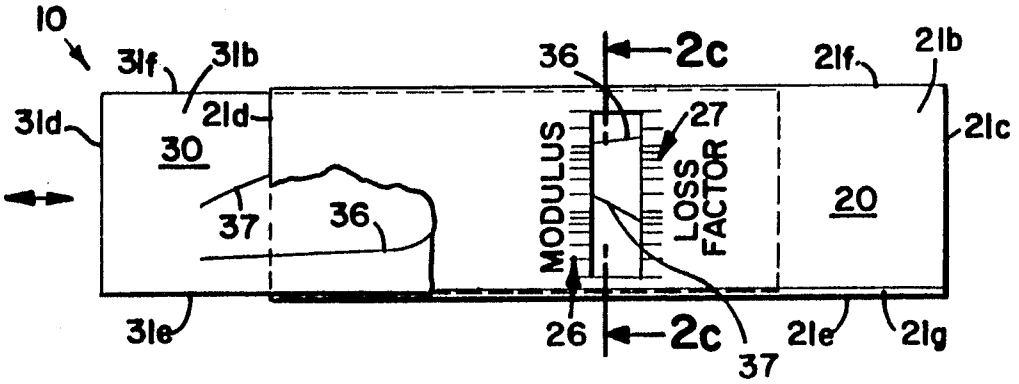
FIG. 2*b* is a rear view of the invention depicted in FIG. 2*a* with a section of the sleeve broken-away to facilitate viewing of the insert.
Figure 3A:
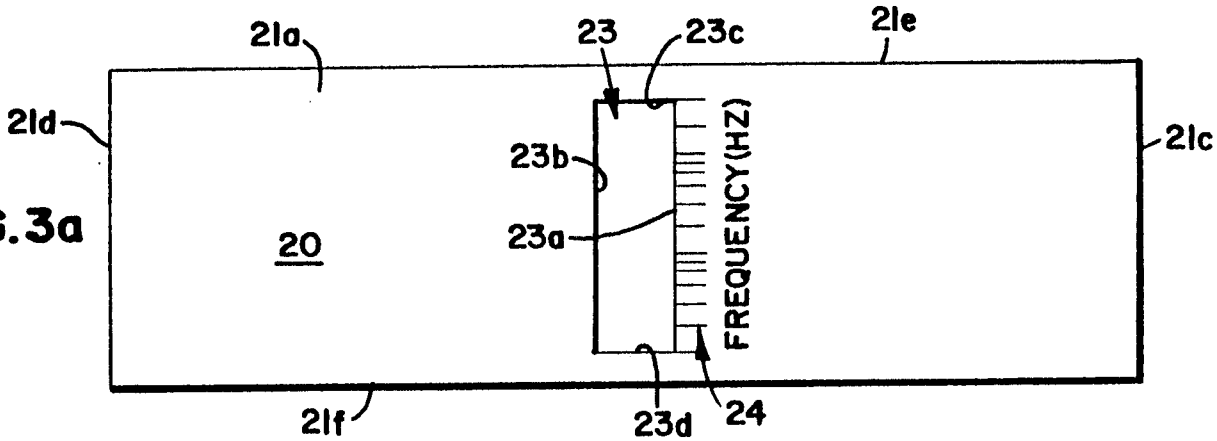
FIG. 3*a* is a front view of the sleeve depicted in FIGS. 2*a* and 2*b*.
Figure 3B:
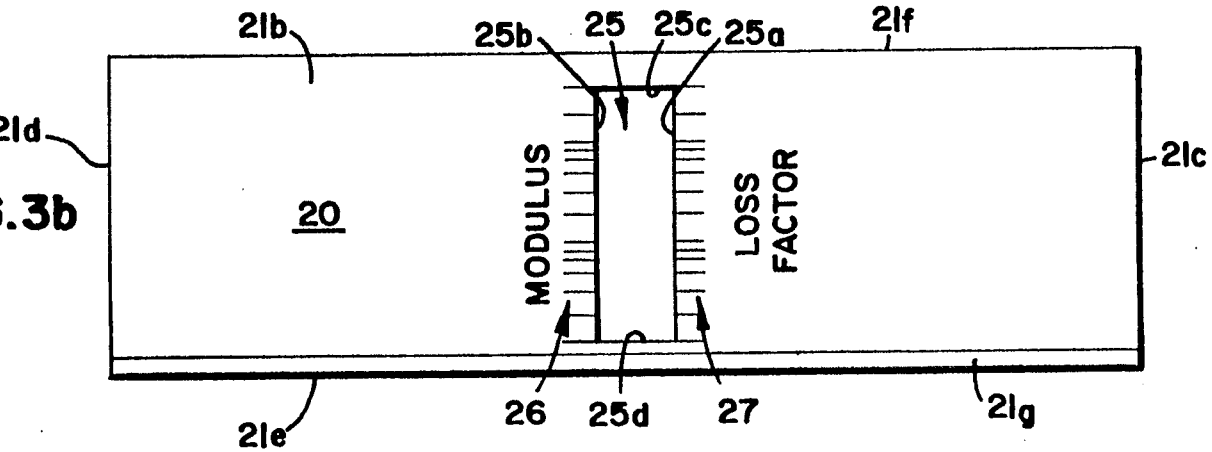
FIG. 3*b* is a rear view of the sleeve depicted in FIG. 3*a*.
Figure 4A:
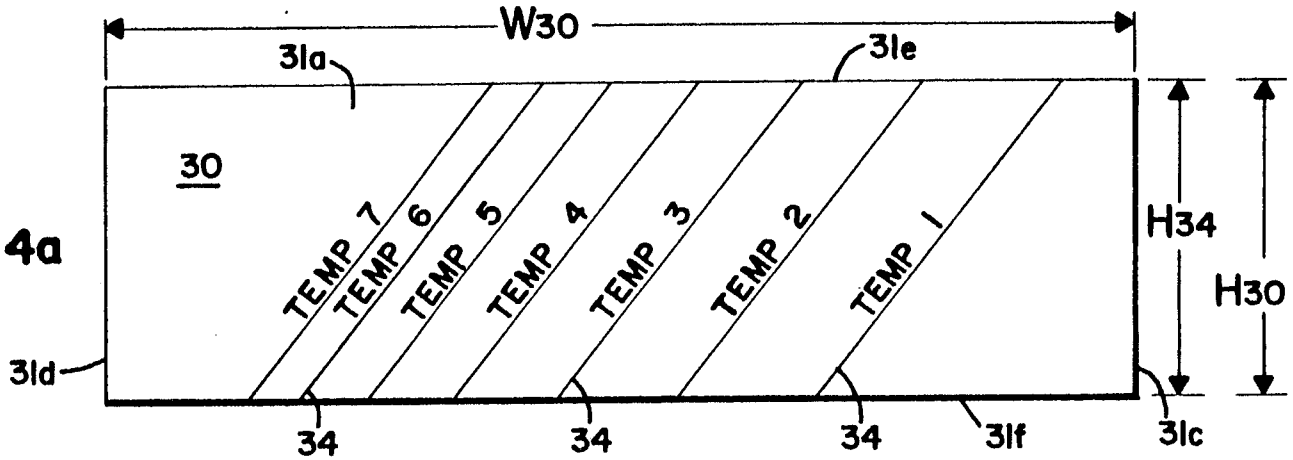
FIG. 4*a* is a front view of the insert depicted in FIGS. 2*a* and 2*b*.
Figure 4B:
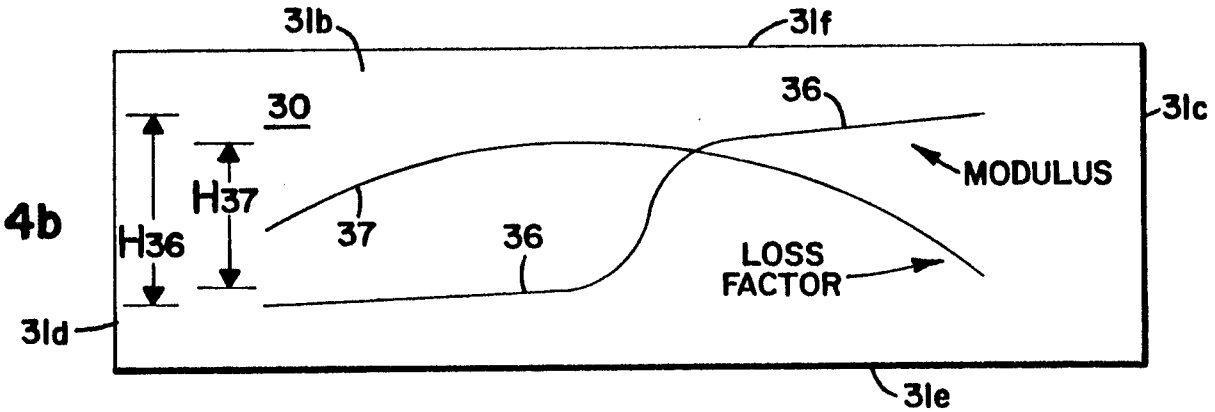
FIG. 4*b* is a rear view of the insert depicted in FIG. 4*a*.

A brief listing of the nomenclature employed in describing the embodiment of the invention depicted in FIGS. 2–4 is provided below for convenience.

NOMENCLATURE

10:mechanical data storage and retrieval device
20:sleeve
21*a*:front panel of sleeve
21*b*:back panel of sleeve
21*c*:right side of sleeve
21*d*:left side of sleeve
21*e*:top edge of sleeve
21*f*:bottom edge of sleeve
21*g*:flap
22:passage
23:temperature isotherm display window
23*a*:right side of isotherm display window
21*b*:left side of isotherm display window
21*c*:top of isotherm display window
21*d*:bottom of isotherm display window
24:frequency scale
25:modulus/loss factor display window
25*a*:right side of modulus/loss factor display window
25*b*:left side of modulus/loss factor display window
25*c*:top of modulus/loss factor display window
25*d*:bottom of modulus/loss factor display window
26:modulus value scale
27:loss factor value scale
30:insert
31*a*:front face of insert
31*b*:back face of insert
31*c*:right side of insert
31*d*:left side of insert
31*e*:top edge of insert
31*f*:bottom edge of insert
34:temperature isotherms
36:modulus curve
37:loss factor curve
$H_{22}$:height of passage
$H_{30}$:height of insert
$W_{30}$:width of insert
$H_{34}$:height of temperature isotherms
$H_{36}$:height of modulus curve
$H_{37}$:height of loss factor curve Referring generally to FIGS. 2*a*, 2*b* and 2*c*, my invention is a mechanical data storage and retrieval device 10 which includes a sleeve 20 and an insert 30. The sleeve 20 defines a substantially planar passage 22 into which insert 30 may be slidable inserted.

The sleeve 20 has a front panel 21*a*, a back panel 21*b*, an open right side 21*c*, an open left side 21*d*, a top edge 21*e*, and a bottom edge 21*f*. Passage 22 extends from the open right side 21*c* to the open left side 21*d* such that insert 30 may be readily slid from right to left or left to right within the passage 22.

The insert 30 is a single sheet with a front surface 31*a*, a back panel 31*b*, a right side 31*c*, a left side 31*d*, a top edge 31*e*, and a bottom edge 31*f*. The insert 30 is sized and shaped for slidable insertion within passage 22. The insert 30 must be constrained within passage 22 such that the insert in only capable of longitudinal movement relative to the sleeve 20. Lateral movement of the insert 30 relative to the sleeve 20 destroys the cooperative relationship between the data contained on the sleeve 20 and the data contained on the insert 30. A convenient means of providing the appropriate constraint is to match the height $H_{30}$ of the insert 30 to the height $H_{22}$ of the passage 22.

The sleeve 20 can conveniently be manufactured from a rectangular paperboard blank which includes a front panel 21*a*, a back panel 21*b* and a flap 21*g*. Similarly, insert 30 may be conveniently manufactured from a rectangular paperboard blank. The sleeve 20 can be constructed from such a paperboard blank by simply (i) folding the blank slightly off center so as to form the top edge 21*e* and two panels of unequal length, (ii) folding the excess length on the longer of the two panels over the shorter panel to form the bottom edge 21*f*, and then (iii) bonding the folded excess length to the shorter panel. The insert 30 may be constructed from a paperboard blank with a single panel by printing the necessary data on the front and back surfaces of the blank or may be constructed from a paperboard blank with a top and a bottom panel by printing the necessary data on the top and bottom panels of the blank and then folding the blank between the panels to form front and back panels with the appropriate data contained thereon.

The front surface 31*a* of insert 30 includes a graduated sequence of temperature isotherms 34 which represent the temperature range of the vibrating element to be damped. In association with the temperature isotherms 34 printed on the insert 30, the front panel 21*a* of sleeve 20 includes a temperature isotherm display window 23 through which a segment of the temperature isotherms 34 printed on the front surface 31*a* of insert 30 may be viewed. The temperature isotherm display window 23 may be any desired size and shape but must have a height (top 23c to bottom 23d) which at least spans the height $H_{34}$ of the temperature isotherms 34 and preferably provides at least one straight side 23a,23b against which a frequency scale 24 may be plotted. If desired, the temperature isotherms may be provided in logarithmic form in order to decrease the width $W_{30}$ of insert 30 required to provide the necessary temperature range.

A frequency scale 24 which represents the vibrational frequency of the element(s) to be damped is provided along the right side 23a of the temperature isotherm display window 23. Because of the range of frequencies which must typically be included within the frequency scale 24 (typically from 0.1 to 10,000 Hz) the frequency scale 24 is preferably provided in logarithmic form.

The temperature isotherms 34 are inherently angled with respect to the frequency scale 24 on the sleeve 20 such that longitudinal sliding of insert 30 within passage 22 provides for movement of the temperature isotherm 34 up/down the frequency scale 24. In this manner, a given temperature and frequency combination may be coupled by simply sliding the insert 30 within the passage 22 of the sleeve 20 until the isotherm 34 representing the temperature of concern physically contacts the frequency value of concern on the frequency scale 24.

Determination of which temperature isotherms 34 to actually display on the insert 30 is based upon a balance of the competing interests of increased accuracy and simplicity. A smaller gap between displayed temperature isotherms provides for increased accuracy based upon a reduction in the inherent error associated with interpolation between displayed values. A larger gap between displayed temperature isotherms simplifies reading of the values by reducing the amount of information squeezed onto the surface of the insert 30. Generally, I have discovered that a display of temperature isotherms 34 at intervals of about 5° C. to 20° C. provides an appropriate balance between these competing interests. Of course, intervals of less than 5° C. and more than 20° C. may be employed if desired.

The back surface 31b of insert 30 includes experimentally derived curves of the modulus curve 36 and loss factor 37 values for the given damping material. In association with the modulus curve 36 and loss factor curves 37, the back panel 21b of sleeve 20 includes a modulus/loss factor display window 25 through which a segment of the modulus and loss factor curves 36,37 printed on the back surface 31b of insert 30 may be viewed. The modulus/loss factor display window 25 may be any desired size and shape but must have a height (distance from the top 25c to the bottom 25d) which at least spans the height $H_{36}$,$H_{37}$ of the modulus and loss factor curves 36,37 and preferably provides straight sides 25a,25b against which a modulus scale 26 and a loss factor scale 27 may be plotted.

A modulus scale 26 is provided along the left side 25b of the modulus/loss factor display window 25 for providing the values of the datapoints represented by the modulus curve 36. While the range of modulus values which the modulus scale 26 must provide is dictated by the modulus curve 36, the modulus scale 26 must typically provide modulus values from about 10,000 Pascal to about 1,000,000,000 Pascal and is therefore preferably provided in logarithmic form.

Similarly, a loss factor scale 27 is provided along the right side 25a of the modulus/loss factor display window 25 for providing the values of the datapoints represented by the loss factor curve 37. While the range of loss factor values which the loss factor scale 27 must provide is dictated by the loss factor curve 37, the loss factor scale 27 must typically provide loss factor values from about 0.1 to about 10 and may be provided in logarithmic form if desired.

The device 10 must indicate the damping material(s) represented by the data on the device 10.

It is possible to provide the modulus 36 and loss factor 37 curves for multiple damping materials on the back surface 31b of the insert 30. When curves for multiple materials are provided the curves for each material must be differentiated from the curves for other materials by such means as color coding, dashed lines, coded lines, separate windows, or other suitable means for distinguishing between materials. When the device 10 includes data for multiple material(s) the device 10 must include a legend indicating which damping material is represented by which curve 36,37.

Proper positioning of the frequency scale 24, the temperature isotherms 34, the loss factor scale 27, the modulus scale 26, the loss factor curve 37, and the modulus curve 36 with respect to one another is critical to proper functioning of the device 10. Improper positioning of the sleeve 20 relative to the insert 30 and/or improper positioning of the data on the sleeve 20 and/or insert 30 results in a corresponding improper positioning of data within the display windows 23,25. The data must be positioned such that coupling of a temperature and frequency value results in retrieval of the modulus and loss factor values from the modulus and loss factor curves 36,37 corresponding to the coupled temperature and frequency.

In this respect, positioning of the frequency scale 24, the temperature isotherms 34, the modulus scale 26, and the modulus curve 36 are interrelated with respect to obtaining the appropriate modulus value while positioning of the frequency scale 24, the temperature isotherms 34, the loss factor scale 27, and the loss factor curve 37 are interrelated with respect to obtaining the appropriate loss factor value. The relative positions of the modulus scale 26 and modulus curve 36 with respect to the loss factor scale 27 and loss factor curve 37 is irrelevant to the proper functioning of the device 10 and may be provided at two separate and distinct locations on a single device 10 with the use of two different highlighting means or may even be provided on separate devices 10 if desired.

The loss factor curve 37 and the modulus curve 36 must be identifiable in order to ensure that the appropriate scale 26,27 is employed for reading the curves 36,37. Several convenient methods to achieve this objective include specifically, but not exclusively, color coding the corresponding scale and curve, labeling the scales and curves, drawing the curves with different symbols (* * * v. - - -) and providing a legend proximate the scales, providing different windows for display of each variable, and the like.

OPERATION OF THE DEVICE

Use of the device 10 to obtain the modulus and loss factor values of a damping material at a particular frequency and temperature simply requires the steps of (i) coupling the temperature and frequency values of concern by sliding the insert 30 within the passage 22 of sleeve 20 until the isotherm representing the temperature of concern physically contacts the frequency value of concern along the right side 23a of the temperature isotherm display window 23, (ii) flipping the device 10 over, (iii) reading the modulus value for that point on the modulus curve 36 which intersects the modulus scale 26, and (iv) reading the loss factor value for that point on the loss factor curve 37 which intersects the loss factor scale 27.

If desired, the frequency scale 24 on the sleeve 20 and the temperature isotherms 34 on the insert 30 may be interchanged so as to provide a temperature scale on the sleeve and frequency isochrons on the insert 30. Such an interchange would intrinsically result in an angular shift in the loss factor and modulus curves 36,37 and/or the modulus and loss factor scales 26,27 corresponding to the angular shift of the temperature and frequency scales 34,24 so as to maintain the appropriate correspondence between the data.

The device 10 may be constructed from an material capable of retaining printed data and providing sufficient structural integrity. Suitable materials for use in constructing the sleeve 20 and insert 30 portions includes specifically, but not exclusively: cellulose products such as wood, paper, and paperboard; plastics such as polyethylene, polypropylene, and polyvinyl chloride; and metals such as aluminum, brass and steel.

The data storage and retrieval device 10 described herein may be constructed in a number of different sizes, shapes, and configurations dependent upon a desired effect. For example, it would also be possible to configured with all of the data and windows on the front panel 21*a* of the sleeve 20 and front surface 31*a* of the insert 30 such that the frequency and temperature data are provided on the top while the modulus and loss factor scale 26,27 and modulus and loss factor curves 36,37 are provided on the bottom.

The specification presented above is intended to aid in a complete, nonlimiting understanding of my invention. Since many different embodiments may be produced without departing from the spirit and scope of my invention, the scope of the invention which I claim resides in the claims hereinafter appended.

I claim:

1. A mechanical device for storage and retrieval of a modulus value and a loss factor value for a selected damping material based upon temperature and frequency variables, which comprises:

(a) a first member having thereon (i) a scale of a first variable, (ii) depiction of modulus values of at least one damping material as a variable of temperature and frequency, and (iii) depiction of loss factor values of at least one damping material as a variable of temperature and frequency, and (b) a second member restrainably movable with respect to the first member and having thereon (i) a scale of a second variable, and (ii) at least one means for locating said modulus value and said loss factor value from the modulus and loss factor values provided on the first member, (c) wherein the first and second variable includes one temperature scale and one frequency scale, and (d) wherein the first member and second member are mated such that coupling of a temperature value and a frequency value by movement of the first member and the second member relative to one another results in identification of the modulus value and loss factor value of the damping material by the locating means at the coupled temperature value and frequency value.

2. The mechanical device of claim 1 wherein the second member is a substantially planar sleeve defining a passage and the first member is a substantially planar insert configured and arranged for slidable retention within the passage.

3. The mechanical device of claim 2 wherein the first member and second member are moveable relative to one another along a single plane and along a single axis within that plane.

4. The mechanical device of claim 1 wherein the scale of the first variable is a graduated sequence of isotherms.

5. The mechanical device of claim 1 wherein the scale of the second variable is a logarithmic scale of frequency.

6. The mechanical device of claim 4 wherein the scale of the second variable is a logarithmic scale of frequency.

7. The mechanical device of claim 1 wherein the locating means is at least one modulus/loss factor display window.

8. The mechanical device of claim 7 wherein the modulus and loss factor values on the first member are covered by the second member except for a segment of the modulus and loss factor values which is within the modulus/loss factor display window.

9. The mechanical device of claim 7 wherein the locating means is a single modulus/loss factor display window.

10. The mechanical device of claim 1 wherein the modulus and loss factor values are graphically depicted on the first member, and the second member includes a modulus scale and a loss factor scale which cooperate with the graphic depiction of the modulus and loss factor values respectively for locating said modulus value and said loss factor value from the modulus and loss factor graphs based upon relative positions of the first member and second member.

11. The mechanical device of claim 10 wherein the modulus and loss factor values are graphically presented as a plotted curve.

12. The mechanical device of claim 2 wherein the modulus and loss factor values are graphically depicted and the second member includes a modulus scale and a loss factor scale which cooperate with the graphic depiction of the modulus and loss factor values respectively for locating said modulus value and said loss factor value from the modulus and loss factor graphs based upon relative positions of the first member and second member.

13. The mechanical device of claim 10 wherein the scale of the first variable is a logarithmic scale of frequency and the modulus scale is a logarithmic scale of modulus values.

14. The mechanical device of claim 13 wherein the loss factor scale is a logarithmic scale of loss factor values.

15. The mechanical device of claim 1, wherein coupling of the temperature value and frequency value comprise interrelationship of the temperature value from the temperature scale and the frequency value from the frequency scale.

16. The mechanical device of claim 6 wherein coupling of the temperature value and frequency value comprise interrelationship of the temperature value from the temperature scale and the frequency value from the frequency scale.

17. The mechanical device of claim 2 wherein (i) the first member has a front surface and a back surface, (ii) the second member has a front panel and a back panel, (iii) the device is configured and arranged such that the front surface and back surface of the first member are conjoined with the front panel and back panel of the second member respectively, (iv) the first variable scale is provided on the front surface of the first member, (v) the second variable scale is provided on the front panel of the second member, (vi) the modulus and loss factor values are provided on the back surface of the first member, and (vii) the locating means is provided on the back panel of the second member.

18. The mechanical device of claim 6 wherein (i) the second member includes a temperature isotherm display window, (ii) the temperature isotherms on the first member are covered by the second member except for a segment of the isotherms which is within the isotherm display window, and (ii) the frequency scale is positioned immediately along a side of the isotherm window so as to facilitate coupling of the temperature value and frequency value.

19. The mechanical device of claim 7 wherein (i) the modulus and loss factor values are graphically presented as plotted curves, (ii) the modulus scale is positioned immediately along a first side of the modulus/-loss factor display window to facilitate valuation of data points on a modulus curve, and (iii) the loss factor scale is positioned immediately along a second side of the modulus/loss factor display window opposite the first side of the modulus/loss factor display window to facilitate valuation of data points on the loss factor curve.

20. A mechanical device for providing a modulus value and a loss factor value for a selected damping material based upon temperature and frequency variables, which comprises:

(a) a substantially planar, rectangular insert, which includes, (i) a front surface containing a graduated sequence of isotherms, and (ii) a rear surface containing plotted curves of modulus datapoint and los factor datapoint values for a damping material as a variable of temperature and frequency, and (b) a substantially planar, rectangular sleeve restrainably retaining the insert within a passage defined by the sleeve, and including, (i) a front panel containing, (aa) a rectangular temperature isotherm display window having a right side and a left side, (bb) a logarithmic frequency scale positioned immediately along one side of the isotherm window, and (ii) a back panel containing, (aa) a rectangular modulus/loss factor display window having a right side and a left side, (bb) a modulus scale positioned immediately along a first side of the modulus/loss factor display window for cooperatively interacting with the modulus curve so as to provide values for the datapoints represented by the modulus curve, and (cc) a loss factor scale positioned immediately along a second side of the modulus/loss factor display window for cooperatively interacting with the loss factor curve so as to provide values for the datapoints represented by the loss factor curve, (c) wherein the insert and sleeve are mated such that alignment of a temperature value from the temperature isotherms and a frequency value from the frequency scale by movement of the insert and sleeve relative to one another results in identification of the modulus value and loss factor value of the damping material at the aligned temperature and frequency values by the modulus/loss factor display window.

* * * * *

UNITED STATES PATENT AND TRADEMARK OFFICE

CERTIFICATE OF CORRECTION

PATENT NO. : 5,148,006

DATED : September 15, 1992

INVENTOR(S) : William A. Driscoll

It is certified that error appears in the above-indentified patent and that said Letters Patent is hereby corrected as shown below:

Col. 2, line 22, "$\sigma = E(1 + i\Phi)\cap$" should read --

$\sigma = E(1 + i\cap)\Phi$--.

Col. 2, line 60, "843089" should read --84-3089--.

Col. 5, lines 57, 58, 59, "21b, 21c, 21d" should read --23b, 23c, 23d--.

Col. 9, line 15, "an" should read --any--.

Signed and Sealed this

Twenty-first Day of February, 1995

*Attest:*

Bruce Lehman

BRUCE LEHMAN

*Attesting Officer*

*Commissioner of Patents and Trademarks*